US009153922B2

(12) United States Patent
Chen et al.

(10) Patent No.: US 9,153,922 B2
(45) Date of Patent: Oct. 6, 2015

(54) MULTI-APPLICATION CONNECTOR

(71) Applicant: Ting-Chi Chen, New Taipei (TW)

(72) Inventors: Ting-Chi Chen, New Taipei (TW); Su-Yung Chou, New Taipei (TW); Yi-Chieh Lin, New Taipei (TW); Te-Fu Lu, New Taipei (JP)

(73) Assignee: Ting-Chi Chen, New Taipei (TW)

( * ) Notice: Subject to any disclaimer, the term of this patent is extended or adjusted under 35 U.S.C. 154(b) by 3 days.

(21) Appl. No.: 14/090,921

(22) Filed: Nov. 26, 2013

(65) Prior Publication Data

US 2015/0044893 A1 Feb. 12, 2015

(30) Foreign Application Priority Data

Aug. 7, 2013 (TW) ..... 102128347 A

(51) Int. Cl.
*H01R 29/00* (2006.01)
*H01R 31/06* (2006.01)

(52) U.S. Cl.
CPC ..... *H01R 29/00* (2013.01); *H01R 31/065* (2013.01)

(58) Field of Classification Search
CPC ..... H01R 13/65802; H01R 23/025; H01R 23/6873; H01R 13/658; H01R 23/02; H01R 31/06; H01R 31/065
See application file for complete search history.

(56) References Cited

U.S. PATENT DOCUMENTS

| | | | | |
|---|---|---|---|---|
| 6,382,987 | B1 * | 5/2002 | Yu | 439/79 |
| 7,288,006 | B2 * | 10/2007 | Su et al. | 439/638 |
| 8,113,882 | B1 * | 2/2012 | Chen | 439/607.01 |
| 8,708,748 | B2 * | 4/2014 | Lin | 439/626 |
| 2008/0242133 | A1 * | 10/2008 | Herlitz et al. | 439/166 |
| 2010/0123006 | A1 * | 5/2010 | Chen | 235/441 |

* cited by examiner

*Primary Examiner* — Gary Paumen
(74) *Attorney, Agent, or Firm* — Muncy, Geissler, Olds & Lowe, P.C.

(57) ABSTRACT

A multi-application connector includes a mating connection module including an electrical insulating terminal holder, a conducting terminal set and a metal shield and configured subject to a first predetermined electrical connector standard, and an adapter module configured subject to a second predetermined standard and including an electrical insulating terminal holder detachably insertable into the mating connection module, a signal terminal set electrically connectable to the conducting terminal set of the mating connection module and a metal shield surrounding a front tongue block of the electrical insulating terminal holder and signal terminal set of the adapter module.

9 Claims, 10 Drawing Sheets

MULTI-APPLICATION CONNECTOR

This application claims the priority benefit of Taiwan patent application number 102128347, filed on Aug. 7, 2013.

BACKGROUND OF THE INVENTION

1. Field of the Invention

The present invention relates to electrical connectors, and more particularly to a multi-application connector, which includes a mating connection module configured subject to a first predetermined electrical connector standard for the connection of an external mating electrical connector, and an adapter module configured subject to a second predetermined standard and detachably connectable to the mating connection module.

2. Description of the Related Art

Following fast development of computer electronic technology, many high mobility electrical and electronic apparatus are well developed and widely used by people for different applications, bringing convenience to people and making people's life more comfortable. Further, high-speed, high-power and sophisticated mobile electrical and electronic devices and related products with large capacity and low profile characteristics have been continuously created. Further, many different transmission interfaces and connectors are widely used in electrical and electronic products for power and data transmission. For connecting different component parts, different transmission interfaces or connectors of different sizes and configurations must be used. Therefore, an electrical or electronic device needs to provide sufficient installation space for the installation of different types of transmission interfaces and connectors.

Further, it is the market trend to create mobility electronic apparatuses having light, thin, short and small characteristics. In consequence, circuit board electronic components must be made extremely strong, small and precise. Further, many different male and female electrical connectors are used in an electronic apparatus to connect different components and parts to a circuit board for the connection of mating electronic cards and/or connectors. These electrical connectors occupy much circuit layout space of the circuit board and the inside space of the electronic apparatus. It is quite important to fully utilize the circuit layout space of a circuit board and the internal space of an electronic apparatus.

SUMMARY OF THE INVENTION

The present invention has been accomplished under the circumstances in view. It is one object of the present invention to provide a multi-application connector, which requires less installation space and provides a wide range of applications.

To achieve this and other objects of the present invention, a multi-application connector in accordance with the present invention comprises a mating connection module configured subject to a first predetermined electrical connector standard, and an adapter module configured subject to a second predetermined standard and detachably connectable to the mating connection module. The mating connection module can be selectively configured subject to USB2.0, HDMI, SATA or eSATA specifications, comprising an electrical insulating terminal holder, a conducting terminal set mounted in the electrical insulating terminal holder of the mating connection module, and a metal shield surrounding the electrical insulating terminal holder and conducting terminal set of the mating connection module and defining with electrical insulating terminal holder and conducting terminal set of the mating connection module an electrical connector insertion space for receiving an external mating electrical connector. The conducting terminal set comprises a plurality of conducting terminals and transmission terminals. The conducting terminals and transmission terminals each comprise a mating contact portion located at one end thereof and positioned in a front side of the electrical insulating terminal holder of the mating connection module, and a bonding portion located at an opposite end thereof and extended out of the electrical insulating terminal holder of the mating connection module for bonding to an external circuit means.

Further, the electrical insulating terminal holder of the mating connection module comprises a plurality of terminal slots cut through opposing top and bottom walls thereof in parallel, and a mating surface portion located at a front side thereof. The mating contact portions of the conducting terminals are defined as first mating contact portions and respectively suspending in the terminal slots. The mating contact portions of the transmission terminals are defined as second mating contact portions and respectively supported on the mating surface portion.

Further, the adapter module comprises an electrical insulating terminal holder insertable into the electrical connector insertion space, a signal terminal set mounted in the electrical insulating terminal holder of the adapter module, and a metal shield surrounding a front part of the electrical insulating terminal holder of the adapter module and the signal terminals. The signal terminal set comprises a plurality of signal terminals. Each signal terminal comprises a mating contact portion located at a front side thereof and an abutment portion located at a rear side thereof. The electrical insulating terminal holder of the adapter module comprises a base portion, a recessed chamber defined in a rear bottom side of the base portion, a tongue block forwardly extended from a front side of the base portion, and a plurality of terminal grooves defined in said tongue block in a parallel manner. The signal terminals of the signal terminal set are respectively mounted in the electrical insulating terminal holder of the adapter module in such a manner that the mating contact portions of the signal terminals are suspending in the recessed chamber and the abutment portions of the signal terminals are respectively extended out of the electrical insulating terminal holder of the adapter module. Further, the adapter module is selectively configured subject to Micro USB2.0, Micro USB3.0, Mini USB2.0, Mini USB3.0 or Mini HDMI specifications, and detachably connectable the mating connection module.

DETAILED DESCRIPTION OF THE PREFERRED EMBODIMENT

Figure 1:
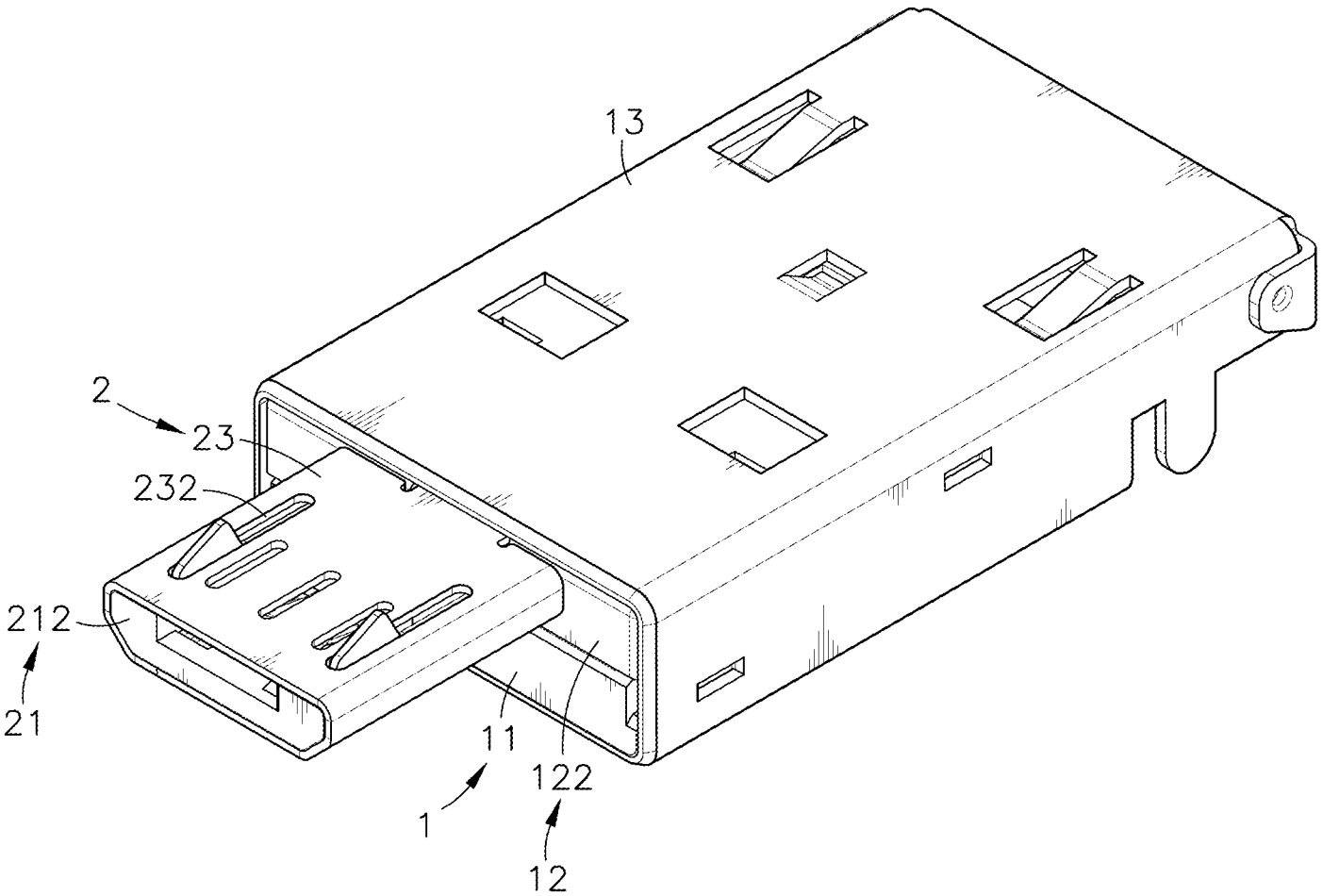
FIG. 1 is an oblique top elevation of a multi-application connector in accordance with a first embodiment of the present invention.
Figure 2:
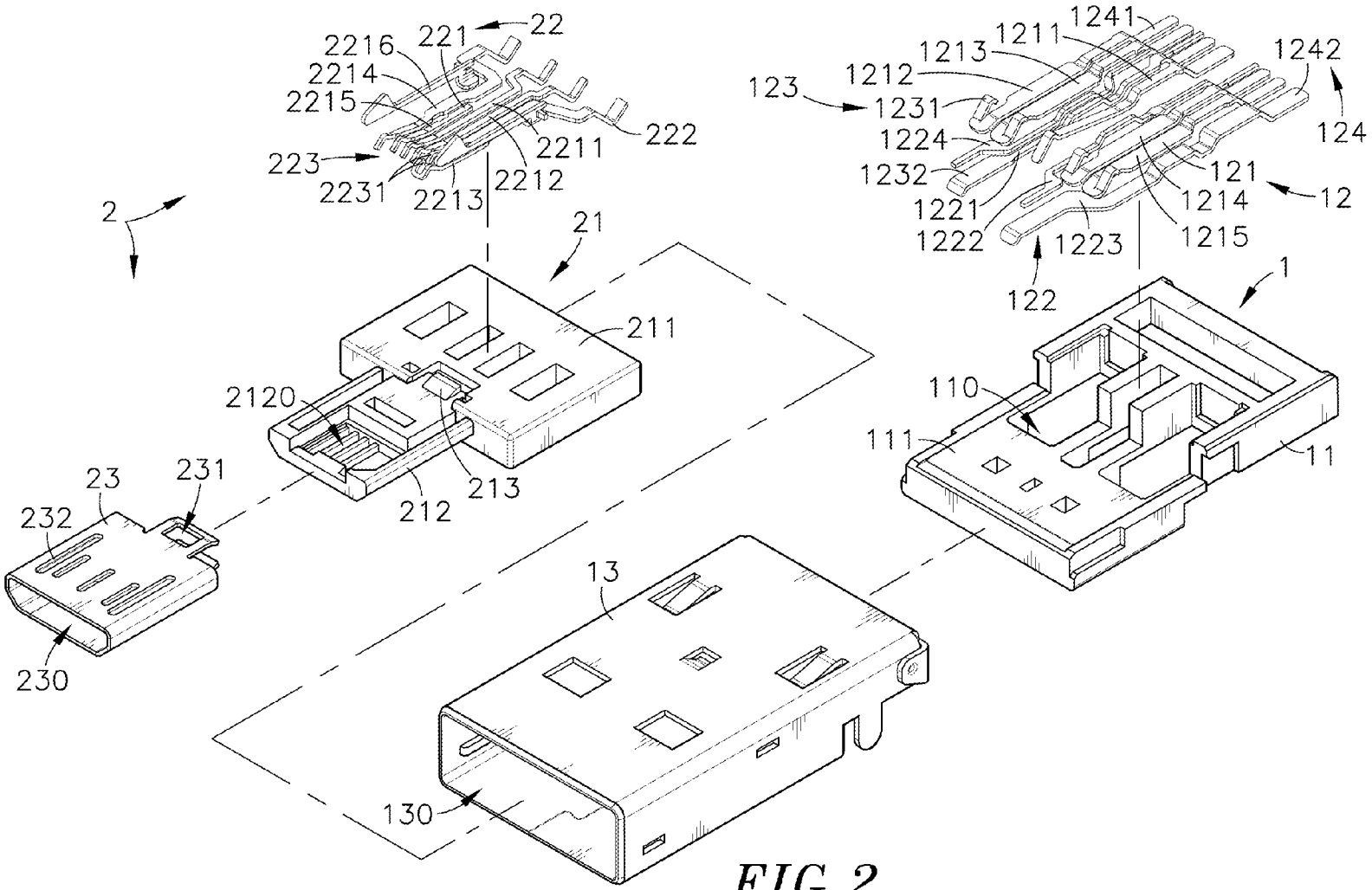
FIG. 2 is an exploded view of the multi-application connector in accordance with the first embodiment of the present invention.
Figure 3:
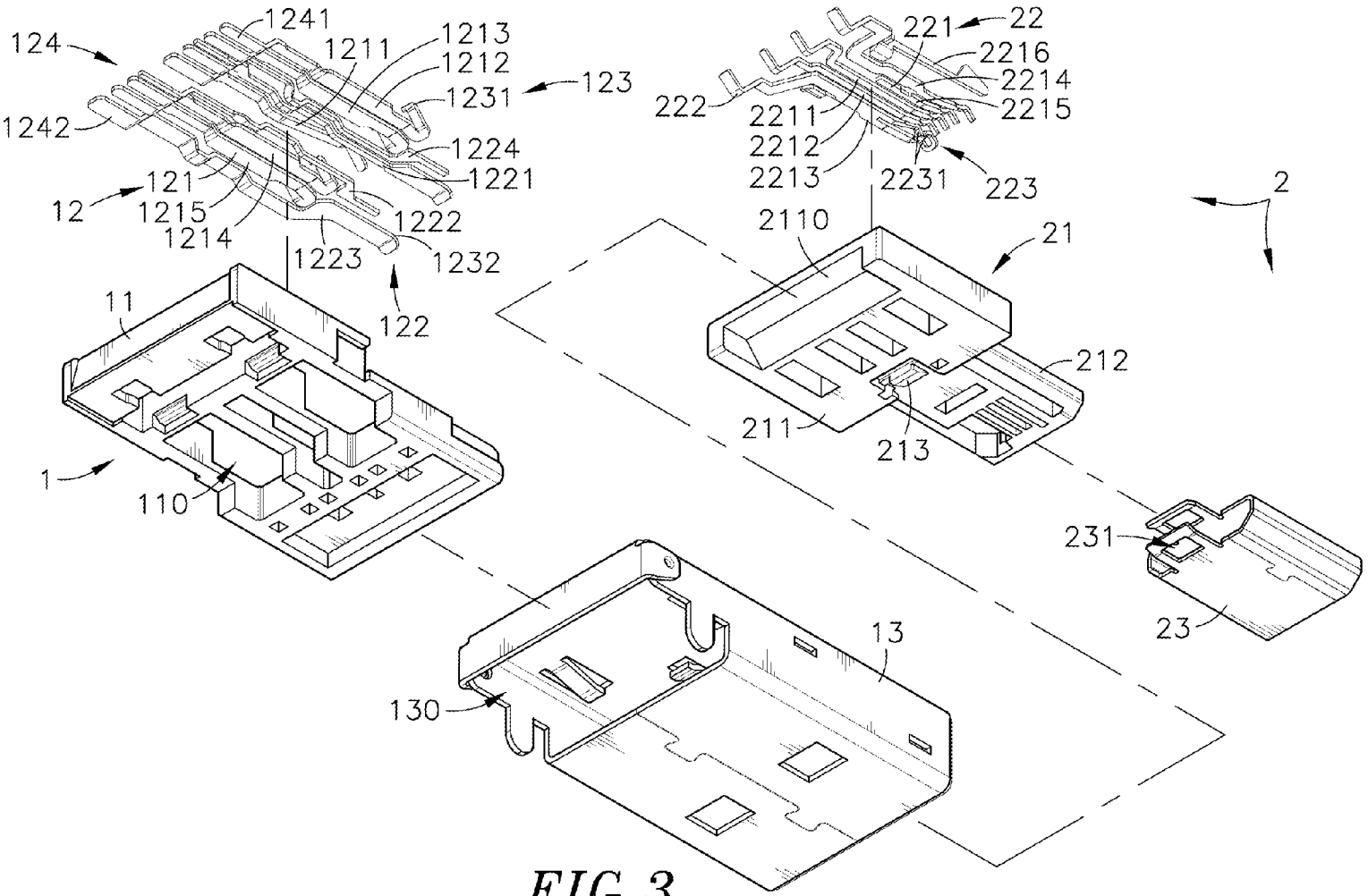
FIG. 3 corresponds to FIG. 2 when viewed from another angle.
Figure 4:
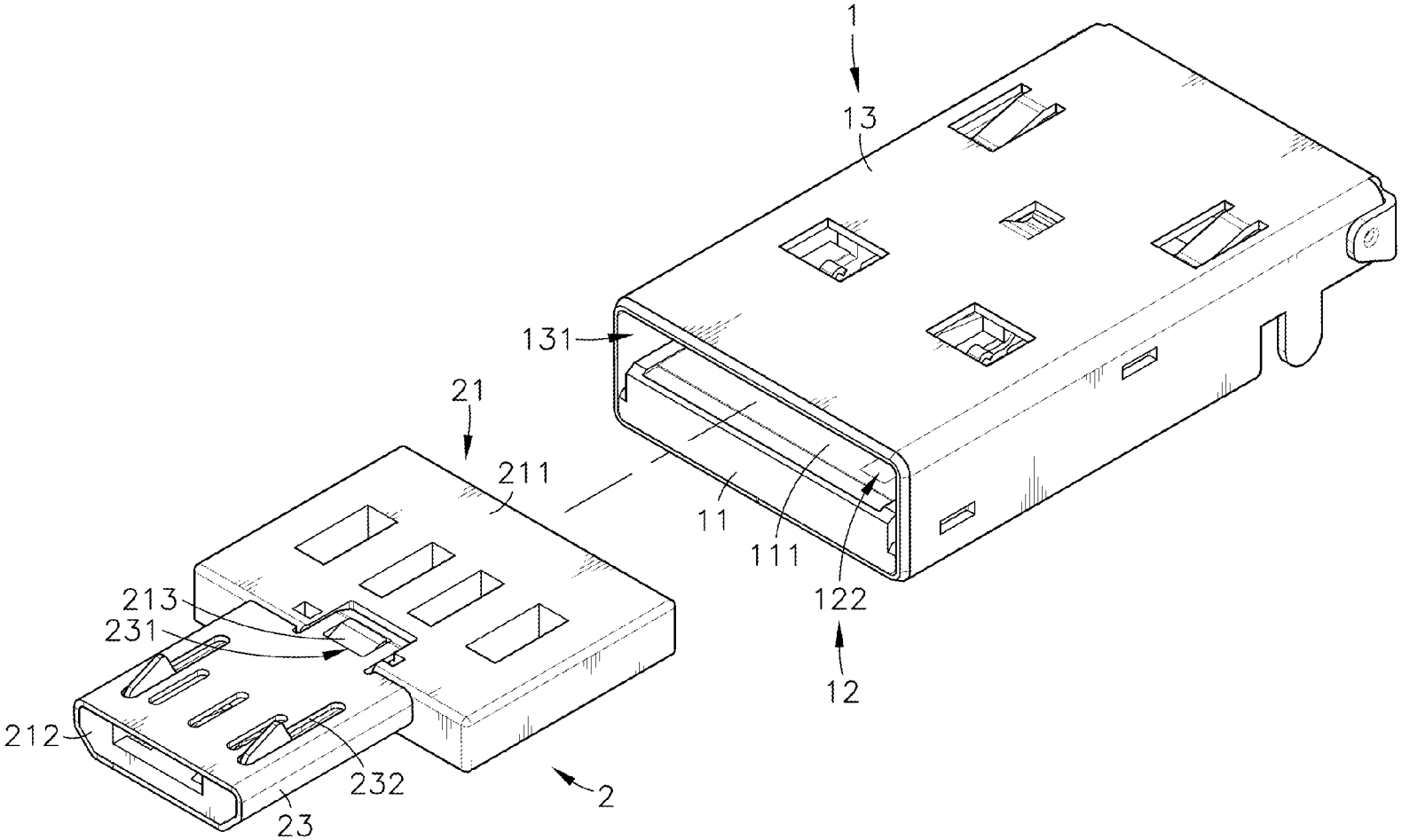
FIG. 4 is an exploded view of present invention, illustrating the mating connection module and the adapter module respectively assembled before connection.

Referring to FIGS. 1-4, a multi-application connector in accordance with the present invention is shown. As illustrated, the multi-application connector in accordance with the present invention comprises a mating connection module 1 and an adapter module 2.

The mating connection module 1 comprises an electrical insulating terminal holder 11, a conducting terminal set 12, and a metal shield 13. The electrical insulating terminal holder 11 defines a plurality of terminal slots 110 cut through opposing top and bottom walls thereof in parallel and a mating surface portion 111 located at a front side thereof in front of the terminal slots 110. The conducting terminal set 12 comprises a plurality of conducting terminals 121 and a plurality of transmission terminals 122. Each of the conducting terminals 121 and transmission terminals 122 has its one end terminating in a mating contact portion 123 and its other end terminating in a bonding portion 124. The mating contact portions 123 and bonding portions 124 of the conducting terminals 121 are respectively defined as first mating contact portions 1231 and first bonding portions 1241. The mating contact portions 123 and bonding portions 124 of the transmission terminals 122 are respectively defined as second mating contact portions 1232 and second bonding portions 1242. The conducting terminals 121 and the transmission terminals 122 are respectively mounted in the electrical insulating terminal holder 11 in such a manner that the first mating contact portions 1231 of the conducting terminals 121 are respectively suspending in the terminal slots 110; the second mating contact portions 1232 of the transmission terminals 122 are respectively supported on the mating surface portion 111; the first bonding portions 1241 and second bonding portions 1242 of the conducting terminals 121 and transmission terminals 122 of the conducting terminal set 12 are respectively extended out of an opposing rear side of the electrical insulating terminal holder 11 remote from the mating surface portion 111 for bonding to an external circuit board. The metal shield 13 defines therein an accommodation chamber 130 for accommodating the electrical insulating terminal holder 11 and the conducting terminal set 12. When the mating connection module 1 is assembled, the accommodation chamber 130 of the metal shield 13, the electrical insulating terminal holder 11 and the conducting terminal set 12 constitute an electrical connector insertion space 131 for receiving a predetermined mating electrical connector. This electrical connector insertion space 131 can be selectively configured subject to one of USB2.0, USB3.0, HDMI, SATA and eSATA standards.

The adapter module 2 comprises an electrical insulating terminal holder 21, a signal terminal set 22, and a metal shield 23. The electrical insulating terminal holder 21 comprises a base portion 211 configured to fit the electrical connector insertion space 131 of the mating connection module 1, a recessed chamber 2110 defined in a rear bottom side of the base portion 211, a tongue block 212 forwardly extended from a front side of the base portion 211, two hook blocks 213 respectively disposed at opposing top and bottom wall thereof between the base portion 211 and the tongue block 212, and a plurality of terminal grooves 2120 defined in the tongue block 212 in a parallel manner. The width and thickness of the tongue block 212 are relatively smaller than the width and thickness of the base portion 211. The signal terminal set 22 comprises a plurality of signal terminals 221. Each signal terminal 221 has its one end terminating in an abutment portion 222 and its other end terminating in a mating contact portion 223. The signal terminals 221 are respectively mounted in the electrical insulating terminal holder 21 so that the mating contact portions 223 are suspending in the recessed chamber 2110 and the abutment portion 222 are respectively positioned in the terminal grooves 2120. The metal shield 23 defines therein an accommodation chamber 230 that accommodates the electrical insulating terminal holder 21 and the signal terminal set 22, and two hook holes 231 that are respectively forced into engagement with the hook blocks 213 of the electrical insulating terminal holder 21. When the adapter module 2 is assembled, it constitutes an electrical connector that fits, for example, Micro USB2.0, Micro USB3.0, Mini USB2.0, Mini USB3.0 or Mini HDMI standard.

The mating connection module 1 and the adapter module 2 are detachably connected together. Thus, the mating connection module 1 can be used separately. Alternatively, the mating connection module 1 can be used with the adapter module 2. When the mating connection module 1 is used separately, it works as a USB2.0, USB3.0, HDMI, SATA or eSATA connector, and a mating electrical connector can be inserted into the electrical connector insertion space 131 of the mating connection module 1 for the transmission of power and data signal. If the user inserts the adapter module 2 into the electrical connector insertion space 131 of the mating connection module 1, the abutment portions 222 of the signal terminals 221 of the signal terminal set 22 will be respectively electrically abutted against the mating contact portions 123 (first mating contact portions 1231 and second mating contact portions 1232) of the conducting terminals 121 and transmission terminals 122 of the conducting terminal set 12. Thus, the user can select to use the mating connection module 1 separately, or to use the mating connection module 1 with the adapter module 2 together.

Figure 5:
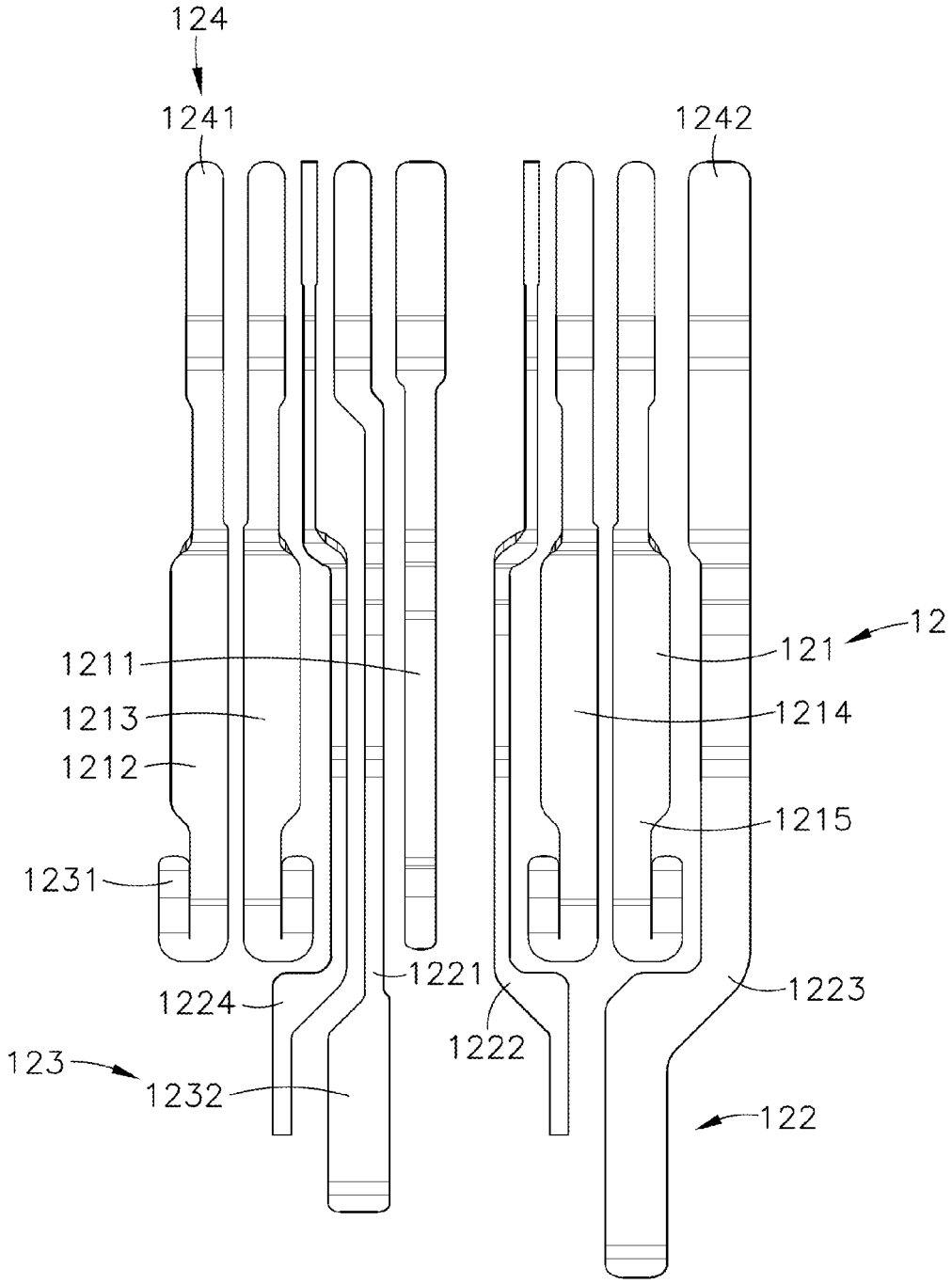
FIG. 5 is a schematic top view illustrating the arrangement of the conducting terminals and transmission terminals of the conducting terminal set in accordance with the present invention.
Figure 6:
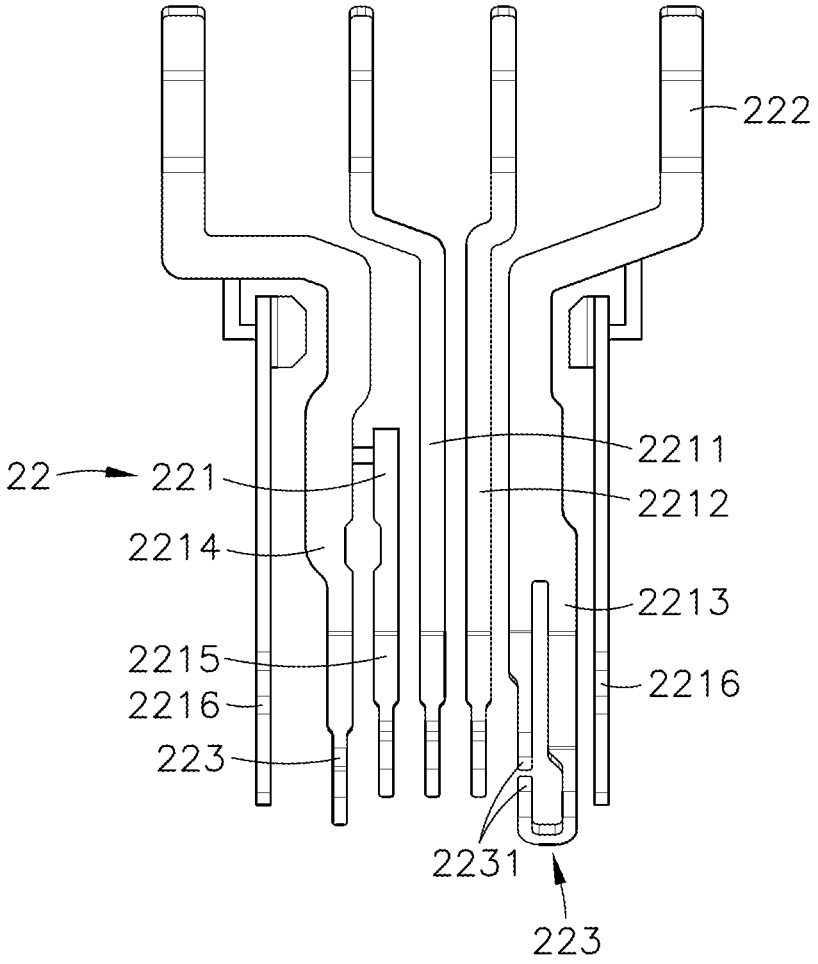
FIG. 6 is a schematic top view illustrating the arrangement of the signal terminals of the signal terminal set in accordance with the present invention.
Figure 7:
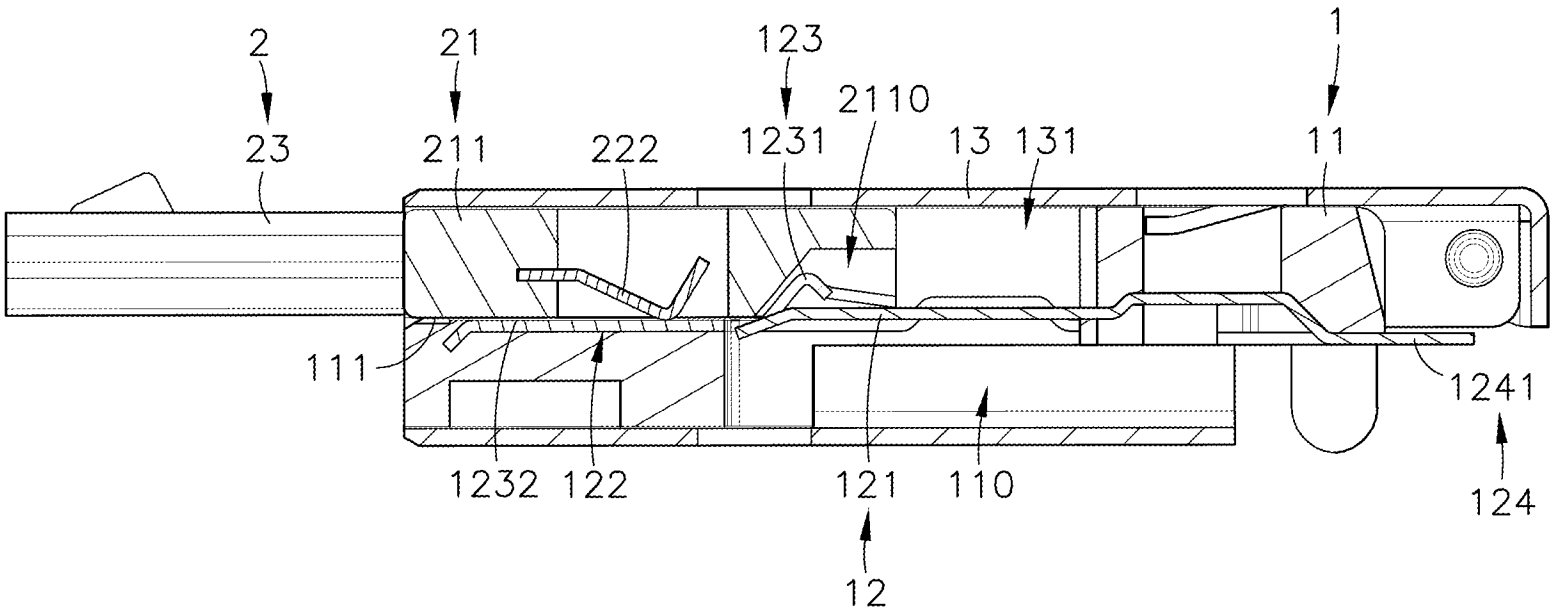
FIG. 7 is a sectional side view of the multi-application connector in accordance with the present invention.

Referring to FIGS. 5-7 and FIGS. 2 and 3 again, the conducting terminal set 12 comprises five conducting terminals 121 and four transmission terminals 122. The five conducting terminals 121 are classified to be: first grounding conducting terminal 1211, first differential signal terminal 1212, second differential signal terminal 1213, third differential signal terminal 1214 and fourth differential signal terminal 1215 that are arranged to fit USB3.0 specification, wherein the first grounding conducting terminal 1211 is disposed on the middle; the first differential signal terminal 1212 and the fourth differential signal terminal 1215 are disposed at two opposite lateral sides relative to the first grounding conducting terminals 1211; the second differential signal terminal 1213 and the third differential signal terminal 1214 are respectively spaced between the two opposite lateral sides of the first grounding conducting terminal 1211 and the first differential signal terminal 1212 and the fourth differential signal terminal 1215. The four transmission terminals 122 are classified to be: fifth differential signal terminal 1221, sixth differential signal terminal 1222, first power terminal 1223 and second grounding terminal 1224 that are arranged to fit USB2.0, HDMI, SATA or eSATA specification, wherein the fifth differential signal terminal 1221 and the sixth differential signal terminal 1222 are arranged in parallel on the middle; the first power terminal 1223 and the second grounding terminal 1224 are disposed at two opposite lateral sides relative to the fifth differential signal terminal 1221 and the sixth differential signal terminal 1222.

Further, the signal terminal set 22 comprises four signal terminals 221 and a supplementary transmission terminal 2215. These four signal terminals 221 are classified to be: seventh differential signal terminal 2211, eighth differential signal terminal 2212, second power terminal 2213, and third grounding terminal 2214. The seventh differential signal terminal 2211, the eighth differential signal terminal 2212, the second power terminal 2213 and the third grounding terminal 2214 are arranged to fit Micro USB2.0, wherein the seventh differential signal terminal 2211 and the eighth differential signal terminal 2212 are arranged in parallel on the middle; the second power terminal 2213 and the third grounding terminal 2214 are disposed at two opposite lateral sides relative to the seventh differential signal terminal 2211 and the eighth differential signal terminal 2212. The supplementary transmission terminal 2215 is spaced between the third grounding terminal 2214 and the seventh differential signal terminal 2211 to constitute with the four signal terminals 221 an electrical connector that fits USB/OTG specifications. Further, the second power terminal 2213 that is disposed at one lateral side relative to the eighth differential signal terminal 2212 has the mating contact portion 223 thereof made relatively larger for high current load. The mating contact portion 223 of the second power terminal 2213 defines two separated contact surfaces 2231 that constitute an open loop configuration. Further, the second power terminal 2213 and the third grounding terminal 2214 of the four signal terminals 221 each comprises a resilient hook rod 2216 respectively forwardly extended from an outer side thereof and respectively inserted through a respective insertion slot 232 in the top wall of the metal shield 23. Thus, the adapter module 2 can be selectively configured to work a Micro USB2.0, Micro USB3.0, Mini USB2.0, Mini USB3.0 or Mini HDMI standard.

Referring to FIGS. 2-5 again, during application, the electrical insulating terminal holder 11, conducting terminal set 12 and metal shield 13 of the mating connection module 1 assembled to work as a USB2.0, USB3.0, HDMI, SATA or eSATA connector for transmitting electronic signals through the conducting terminal set 12. Alternatively, the user can insert the base portion 211 of the electrical insulating terminal holder 21 of the adapter module 2 into the electrical connector insertion space 131 of the mating connection module 1 to electrically abut the abutment portions 222 of the signal terminals 221 of the signal terminal set 22 against the mating contact portions 123 (first mating contact portions 1231 and second mating contact portions 1232) of the respective conducting terminals 121 and transmission terminals 122 of the conducting terminal set 12, constituting a Micro USB2.0, Micro USB3.0, Mini USB2.0, Mini USB3.0 or Mini HDMI connector for the connection of a mating electrical connector. Thus, the multi-application connector can be selectively set for a wide range of applications.

Figure 8:
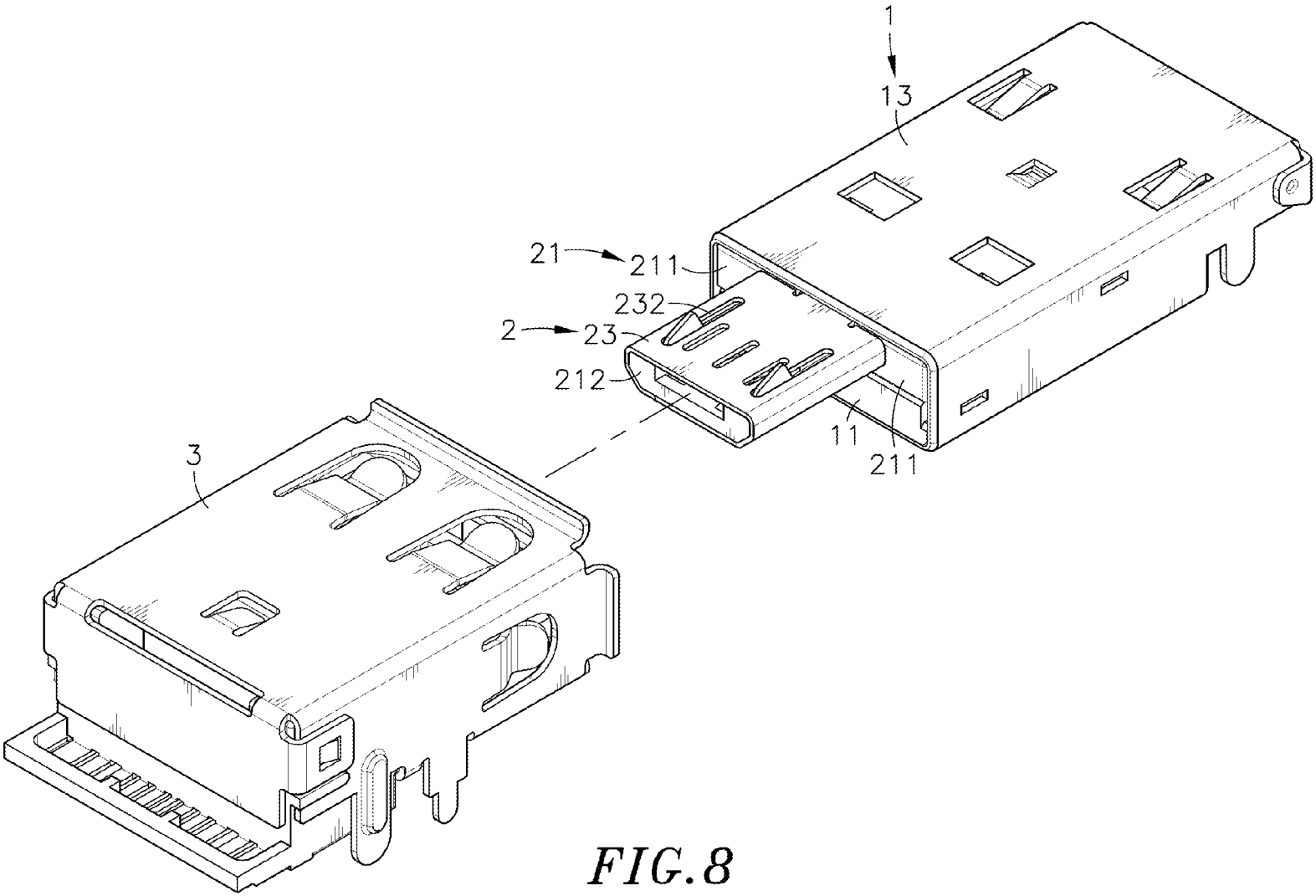
FIG. 8 is a schematic applied view of the present invention, illustrating an application example of the multi-application connector in accordance with the present invention.
Figure 9:
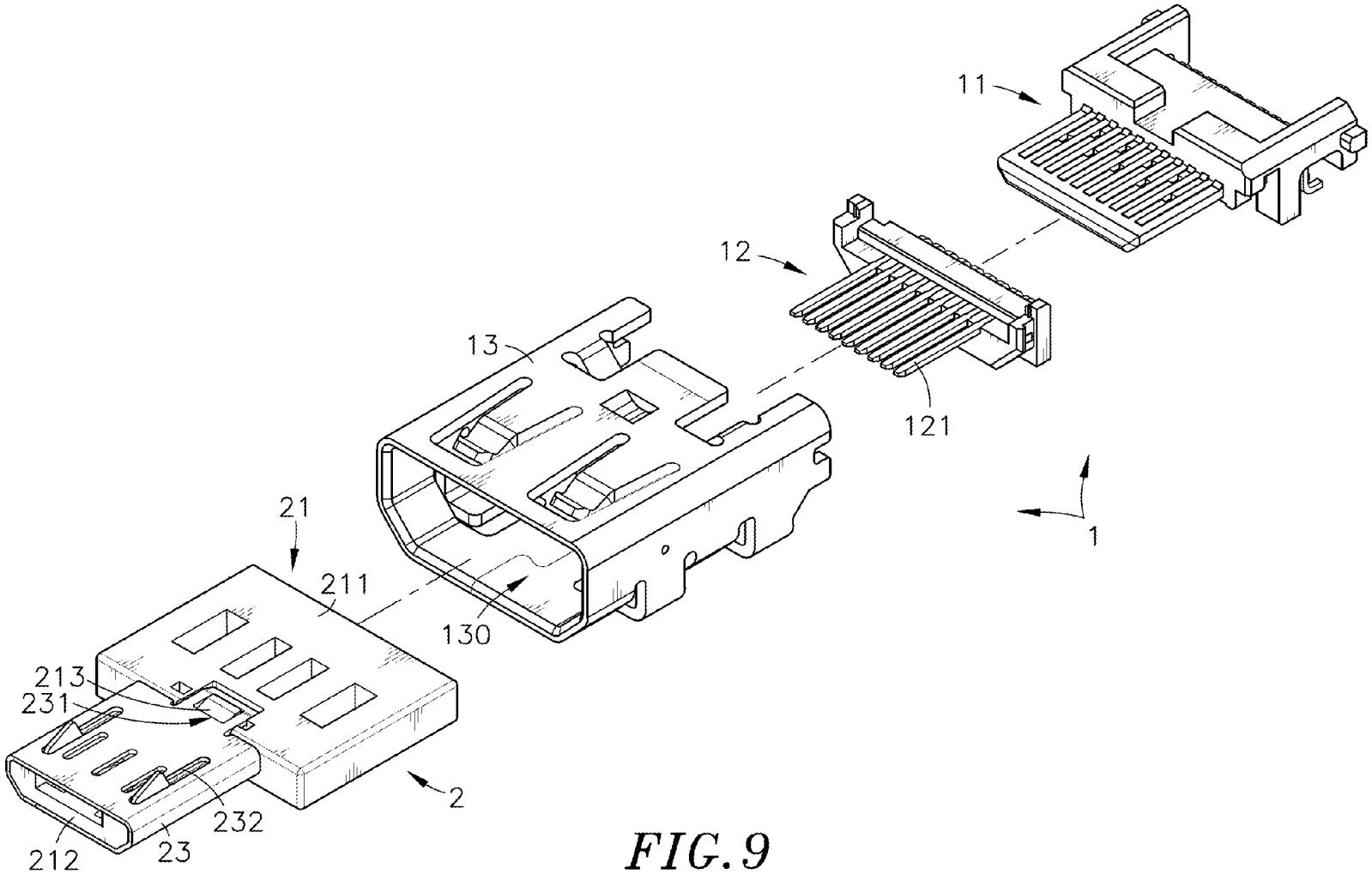
FIG. 9 is another exploded view of the multi-application connector in accordance with the present invention.
Figure 10:
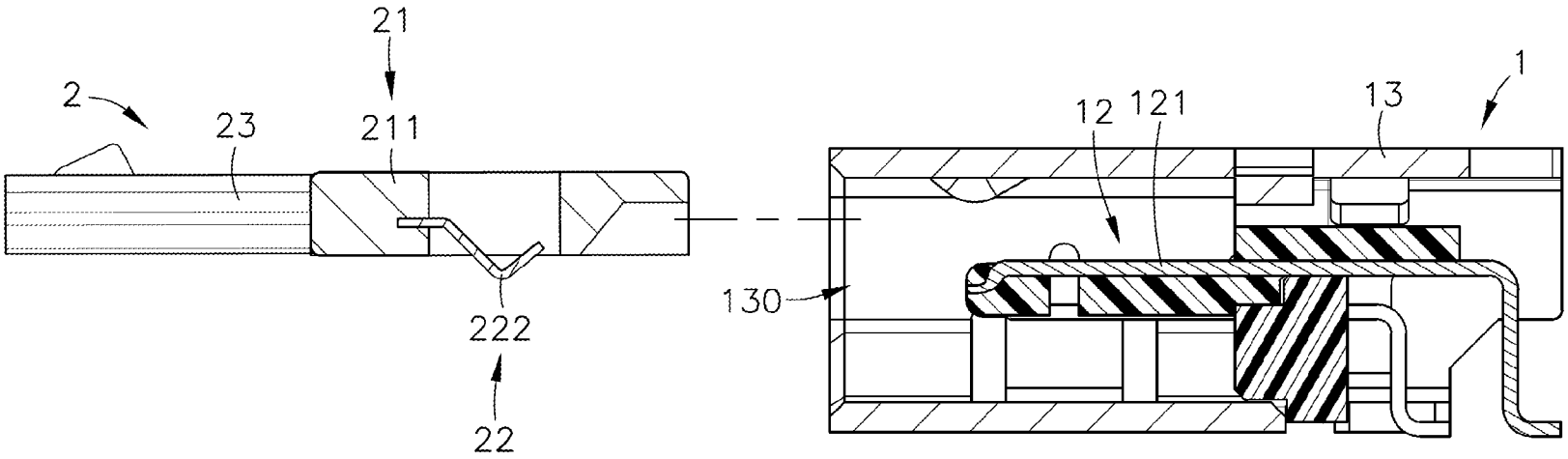
FIG. 10 is a sectional side view of FIG. 9.

Referring to FIGS. 8-10 and FIGS. 2-4 again, the mating connection module 1 can be separately used for the connection of an external mating electrical connector 3. Alternatively, the adapter module 2 can be inserted into the electrical connector insertion space 131 of the mating connection module 1 to electrically connect the conducting terminal set 12 to the signal terminal set 22, and then connect the adapter module 2 to the external mating electrical connector 3. Thus, the multi-application connector provides a wide range of applications.

In conclusion, the invention provides a multi-application connector, which comprises a mating connection module 1 comprising an electrical insulating terminal holder 11, a conducting terminal set 12 and a metal shield 13 and selectively configured to fit USB2.0, HDMI, SATA or eSATA standard, and an adapter module 2 comprising an electrical insulating terminal holder 21, a signal terminal set 22 and a metal shield 23 and detachably and electrically connectable to the adapter module 2 and selectively configured to fit Micro USB2.0, Micro USB3.0, Mini USB2.0, Mini USB3.0 or Mini HDMI standard. Thus, the mating connection module 1 can be used mating connection module 1, or assembled with the adapter module 2 for a different application. Therefore, the multi-application connector saves much installation space and provides a wide range of applications.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A multi-application connector, comprising:

a mating connection module defining therein an electrical connector insertion space for receiving an external mating electrical connector, said mating connection module comprising an electrical insulating terminal holder, a conducting terminal set mounted in the electrical insulating terminal holder of said mating connection module, said conducting terminal set comprising a plurality of conducting terminals and transmission terminals, said conducting terminals and said transmission terminals each comprising a mating contact portion located at one end thereof and positioned in a front side of the electrical insulating terminal holder of said mating connection module and a bonding portion located at an opposite end thereof and extended out of the electrical insulating terminal holder of said mating connection module for bonding to an external circuit means, and a metal shield surrounding the electrical insulating terminal holder and conducting terminal set of said mating connection module; and an adapter module detachably and electrically connectable to said mating connection module, said adapter module comprising an electrical insulating terminal holder insertable into said electrical connector insertion space, a signal terminal set mounted in the electrical insulating terminal holder of said adapter module, said signal terminal set comprising a plurality of signal terminals, each said signal terminal comprising a mating contact portion located at a front side thereof and an abutment portion located at a rear side thereof, the abutment portions of said signal terminals of said signal terminal set being respectively and electrically abutted against the mating contact portions of said conducting terminals and said transmission terminals of said conducting terminal set after insertion of said adapter module into said mating connection module, and a metal shield surrounding a front part of the electrical insulating terminal holder of said adapter module and the mating contact portions of said signal terminals.

2. The multi-application connector as claimed in claim 1, wherein said mating connection module is selectively configured subject to USB2.0, HDMI, SATA or eSATA specifications; said adapter module is selectively configured subject to Micro USB2.0, Micro USB3.0, Mini USB2.0, Mini USB3.0 or Mini HDMI specifications.

3. The multi-application connector as claimed in claim 1, wherein the electrical insulating terminal holder of said mating connection module comprises a plurality of terminal slots cut through opposing top and bottom walls thereof in parallel, and a mating surface portion located at a front side thereof; the mating contact portions of said conducting terminals and said transmission terminals of said conducting terminal set are selectively suspending in said terminal slots and said mating surface portion.

4. The multi-application connector as claimed in claim 3, wherein the mating contact portions of said conducting terminals are defined as first mating contact portions and respectively suspending in said terminal slots; the mating contact portions of said transmission terminals are defined as second mating contact portions and respectively supported on said mating surface portion.

5. The multi-application connector as claimed in claim 1, wherein the electrical insulating terminal holder of said adapter module comprises a base portion, a recessed chamber defined in a rear bottom side of said base portion, a tongue block forwardly extended from a front side of said base portion, and a plurality of terminal grooves defined in said tongue block in a parallel manner for accommodating said signal terminals of said signal terminal set.

6. The multi-application connector as claimed in claim 5, wherein said tongue block has a width and thickness smaller than said base portion.

7. The multi-application connector as claimed in claim 1, wherein the electrical insulating terminal holder of said adapter module comprises a base portion, a recessed chamber defined in a rear bottom side of said base portion, a tongue block forwardly extended from a front side of said base portion, and a plurality of terminal grooves defined in said tongue block in a parallel manner; said signal terminals of said signal terminal set are respectively mounted in the electrical insulating terminal holder of said adapter module in such a manner that the mating contact portions of said signal terminals are suspending in said recessed chamber and the abutment portions of said signal terminals are respectively extended out of the electrical insulating terminal holder of said adapter module.

8. The multi-application connector as claimed in claim 1, wherein the electrical insulating terminal holder of said adapter module comprises a base portion, a recessed chamber defined in a rear bottom side of said base portion, a tongue block forwardly extended from a front side of said base portion and adapted for supporting said signal terminals of said signal terminal set, and two hook blocks respectively disposed at opposing top and bottom wall thereof between said base portion and said tongue block; the metal shield of said adapter module comprises two hook holes respectively forced into engagement with said hook blocks of said electrical insulating terminal holder.

9. The multi-application connector as claimed in claim 1, wherein the electrical insulating terminal holder of said adapter module comprises a base portion, a recessed chamber defined in a rear bottom side of said base portion, a tongue block forwardly extended from a front side of said base portion and adapted for supporting said signal terminals of said signal terminal set, and two hook holes respectively formed in opposing top and bottom wall thereof between said base portion and said tongue block; the metal shield of said adapter module comprises two hook blocks respectively forced into engagement with said hook holes of said electrical insulating terminal holder.

* * * * *